US008235311B2

(12) United States Patent
Broadbent

(10) Patent No.: US 8,235,311 B2
(45) Date of Patent: Aug. 7, 2012

(54) VENTING DEVICE

(75) Inventor: Clive Broadbent, Newton (GB)

(73) Assignee: Global One-Pak Limited, Cheshire (GB)

( * ) Notice: Subject to any disclaimer, the term of this patent is extended or adjusted under 35 U.S.C. 154(b) by 305 days.

(21) Appl. No.: 12/557,796

(22) Filed: Sep. 11, 2009

(65) Prior Publication Data

US 2010/0059606 A1 Mar. 11, 2010

(30) Foreign Application Priority Data

Sep. 11, 2008 (GB) ..... 0816584.7

(51) Int. Cl.
*B05B 9/043* (2006.01)

(52) U.S. Cl. ..... 239/333; 222/189.09; 222/383.1

(58) Field of Classification Search ..... 239/331, 239/333; 222/189.09, 189.11, 321.1, 382, 222/383.1, 321.3, 321.7–321.9, 372, 375
See application file for complete search history.

(56) References Cited

U.S. PATENT DOCUMENTS

| | | | | |
|---|---|---|---|---|
| 5,775,548 | A * | 7/1998 | Hohmann et al. | 222/376 |
| 6,257,455 | B1 * | 7/2001 | Trepina et al. | 222/189.09 |
| 6,715,772 | B1 | 4/2004 | Micciche et al. | |
| 2006/0255075 | A1 * | 11/2006 | Foster et al. | 222/383.1 |

FOREIGN PATENT DOCUMENTS

WO WO 2005094492 10/2005

* cited by examiner

*Primary Examiner* — Darren W Gorman
(74) *Attorney, Agent, or Firm* — Woodard Emhardt & Moriarty McNett & Henry LLP

(57) ABSTRACT

A venting device for a trigger sprayer closure, comprising a venting ring (2) provided with apertures (14) for allowing the passage of fluid, a gasket (4) provided with an aperture (10) covered by a material (12) for allowing the passage of gas but which prevents liquid from passing therethrough, wherein the venting ring (2) is provided with a concentric channel (18) arranged to maintain fluid communication between the one or more apertures (14) of the venting ring (2) and the at least one aperture (10) of the gasket (4) if the relative positions of the respective apertures are changed.

3 Claims, 4 Drawing Sheets

VENTING DEVICE

REFERENCE TO RELATED APPLICATIONS

The present claims the benefit of United Kingdom Patent Application Serial No. 0816584.7, filed 11 Sep. 2008, all of which is hereby incorporated by reference.

The invention to which this application relates is a venting mechanism for a trigger sprayer, although it will be appreciated by persons skilled in the art that the present invention is not limited to trigger sprayers and can be used with other devices having pump mechanisms.

Conventional trigger sprayer products comprise two parts, a spray head which includes the dispensing apparatus, and a container to which the spray head is affixed and from which material is dispensed. The spray head is provided with a handle which actuates a plunger to draw up liquid through a dip tube connected thereto and extending into the container, the liquid being expelled from the spray head via a nozzle.

The venting mechanism of a trigger sprayer product normally allows air into the container to stop the container from collapsing as liquid therein is dispensed. To facilitate this mechanism, a gap is typically created as the plunger is actuated to allow air into the container. However this gap also allows liquid to exit the container if the product is used upside down, which has the undesirable effect that the product leaks liquid.

It is possible to seal the container to prevent outflow of liquid in this way, by using O-rings along the plunger to create a seal, but this then creates a vacuum as the handle is actuated which prevents the product from working properly. In addition, there is a further risk that pressure can build up inside a sealed container, during transportation in hot conditions for example, which may lead to damage to the container.

To prevent such pressure build up, a gasket (also known as a cap liner or wad) is typically provided in the form of a ring of material lining the inside of the closure, having an aperture through which gas can escape. The wad is typically a tri-layer of polyethylene-based material, and the aperture is usually provided with a covering of polytetrafluoroethylene (PTFE) material such as Gore-Tex™ which allows gaseous water to pass therethrough but prevents the escape therethrough of liquid water droplets.

The closure is typically provided with a corresponding aperture such that gas escaping through the aperture in the wad can be vented to the atmosphere via the aperture in the closure. However, a problem with this system is that if the wad and aperture holes are not correctly aligned, gas may be prevented from venting and the containers may explode. While the wad may be bent to allow some movement of air between misaligned holes, if there is a rapid increase in container pressure the wad is flattened by the same which creates a seal and leads to the aforementioned problem.

One way of solving this problem is to provide a wad in which one or more parallel grooves are provided running across the wad from edge to edge, at least one of which coincides with the aperture. No holes are required in the closure in this example, as the gas escapes from the container via the aperture, along the groove and then via the screw-thread of the closure. However, the wad may not be liquid-tight with respect to the closure or landing of the neck finish of the container, which means for example that if the container is inverted, liquid can pass by the side of the wad, and then escape via the thread. In addition the speed of venting is relatively slow as the venting route is somewhat tortuous.

An aim of the invention is to provide a means by which the container can be vented to release pressure while preventing leakage of the liquid therefrom.

In one aspect of the invention, there is provided a venting device for a trigger sprayer closure, comprising:

- a venting ring provided with one or more apertures for allowing the passage of fluid;
- a gasket provided with at least one aperture covered by a material for allowing the passage of gas but preventing liquid from passing therethrough;
- characterised in that the venting ring is provided with a channel arranged to maintain fluid communication between the one or more apertures of the venting ring and the at least one aperture of the gasket if the relative positions of the respective apertures are changed.

In one embodiment the gasket is a ring-shaped wad, with a diameter larger than that of the venting ring, typically substantially the same as that of the inner perimeter of the closure, such that the outer edge of the wad is sandwiched between the closure and container when the venting device is fitted thereto. Typically the gasket is impermeable to fluid i.e. matter in both liquid and gaseous form.

Thus gas can escape through the apertures of the wad and venting ring, but advantageously the respective apertures do not need to be aligned because the channel defines a route between the same. In addition a simple wad can be used, without any grooves, which is advantageously less expensive.

Typically the material-covered aperture in the gasket is located offset from a central axis of the gasket. In other words, the venting aperture is situated on the periphery of the wad.

In one embodiment the channel is concentric with the perimeter of the venting ring. Thus, if the closure is rotated with respect to the wad, the fluid communication between the respective apertures is maintained. As such, if the trigger sprayer components get dislodged during transportation of the same, there is no risk of the containers exploding as the venting mechanism operates irrespective of the relative positions of the wad and the closure.

Typically the apertures of the venting ring vent to the atmosphere. Thus there are no further obstacles to the passage of gas from the container.

Typically the trigger sprayer includes a container for holding liquid, a plunger for pumping the liquid from the container, and a closure for retaining the pumping means on the container.

In one embodiment the venting device is fitted to the closure such that the plunger of the trigger sprayer extends therethrough.

Typically sealing means are provided to provide a liquid seal between the venting ring and the plunger. Typically the sealing means is an O-ring or rubber gasket. It will be appreciated that the sealing means can be made from any suitable material depending on the liquid in the container.

Typically a clamping ring is provided to clamp the wad to the venting ring. This helps ensure that the wad does not bend such that liquid could escape from around the edges thereof and maintains the relative positions of the wad and retaining ring.

Typically the central aperture through the wad is smaller than the diameter of the clamping ring such that leaks are prevented via the central aperture of the wad.

Typically the clamping ring retains the sealing means within the venting device. Typically the clamping ring is provided with a central aperture through which a plunger may extend, and a raised portion around the aperture for abutting the O-ring. The outer portion of the clamping ring may also be raised, defining a concentric channel between the portions into which the venting ring extends. The venting ring and/or clamping ring are typically provided with corresponding protrusions and/or recesses to ensure that the two components are held together.

It will be appreciated that an O-ring is not required for products that require venting but do not necessarily need to be leakproof for use upside-down.

Typically the closure engages the container such that the perimeter of the wad is sandwiched therebetween. Thus a seal is created onto the land of the bottle neck finish. As the venting ring diameter extends to the inner perimeter of the closure, the size of the channel can be maximised to ensure that the gas flow rate through the aperture in the wad is maximised.

In one embodiment the venting ring is provided with a channel for receiving the closure-engaging means such as claws of a sprayhead. Typically the edge of the channel is provided with one or more ridges for engaging corresponding grooves on or adjacent to the claws.

In one embodiment a circumferential ridge and corresponding groove are provided. This ensures that once the claws of the sprayhead have been inserted into the channel of the venting ring, the circumferential ridge engages the corresponding groove to retain the sprayhead on the venting ring. As the ridge and groove are circumferential the sprayhead can rotate freely with respect to the closure, the claws moving through the channel unimpeded.

Thus as the wad is assembled on a component independent to the body of the trigger spray, the venting device provides an anti-back-off feature. As the wad is sealed onto the neck finish of the bottle, when the trigger spray is knocked in transit or during production there is no leakage as the sprayhead turns without disengaging the closure.

Typically the arrangement of the apertures is different to that of the claws such that at least one aperture is not covered by a claw when the device is assembled with the sprayhead. This is also the case if the sprayhead is rotated relative to the venting device.

Typically the apertures are cut in to the venting ring, such that fluid communication with the channel and the atmosphere is maintained irrespective of the position of the claws, and the anti-back-off feature is unimpeded.

In a further aspect of the invention, there is provided a trigger sprayer comprising:

- a container for holding liquid;
- a sprayhead including a plunger for pumping the liquid from the container;
- a closure for retaining the sprayhead on the container;
- a venting ring inside the closure provided with one or more apertures for allowing the passage of fluid;
- a wad with a diameter extending substantially to the inner perimeter of the closure;
- said wad provided with at least one aperture covered by a material for allowing the passage of gas but preventing liquid from passing therethrough;
- characterised in that the venting ring is provided with a channel arranged to maintain fluid communication between the one or more apertures of the venting ring and the at least one aperture of the wad if the relative positions of the respective apertures are changed.

Specific embodiments of the invention are now described wherein.

Figure 1:
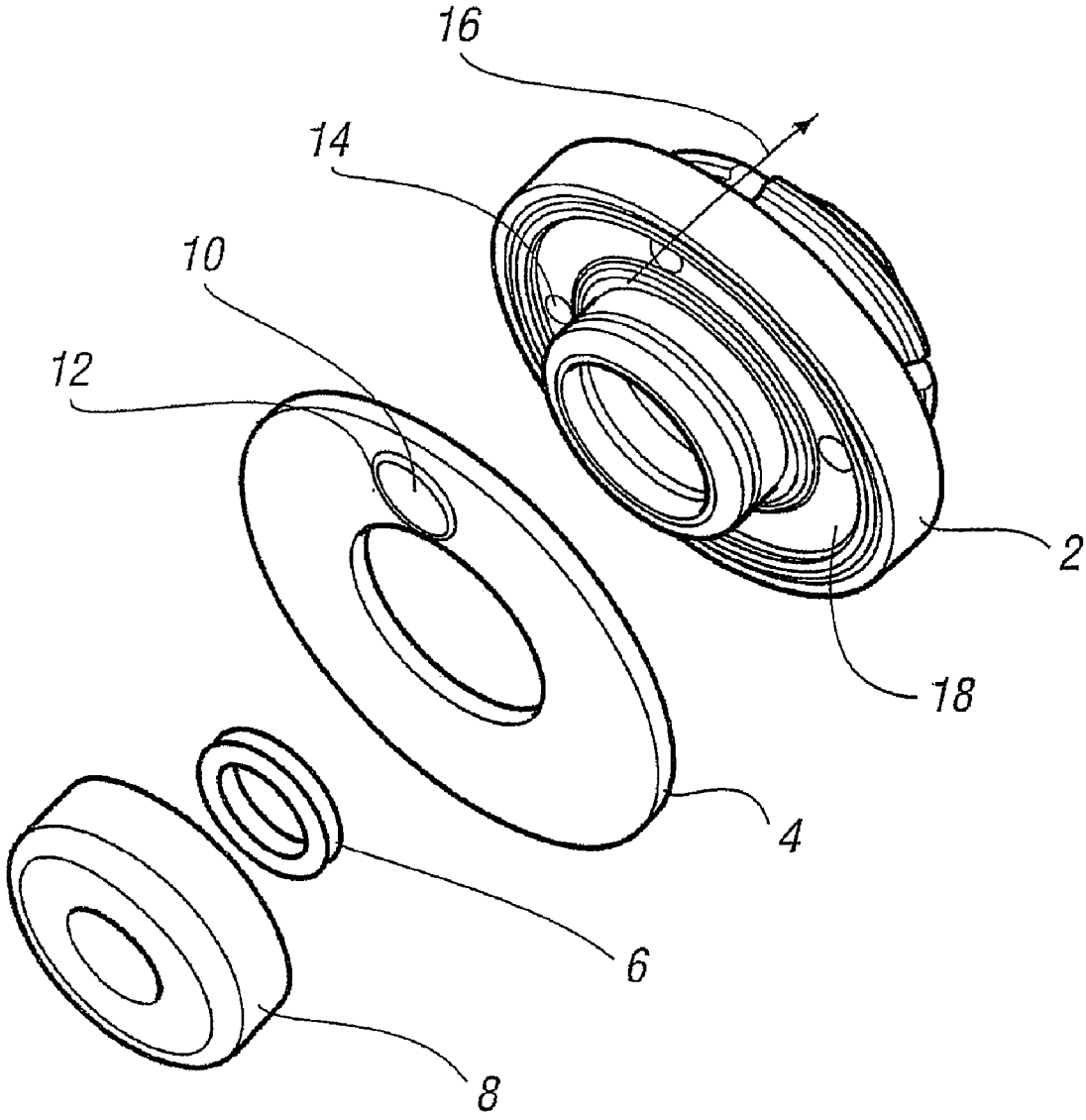
FIG. 1 illustrates an exploded isometric view of a venting device according to one embodiment of the invention.

With reference to FIG. 1, there is illustrated the components of a venting device for a trigger sprayer closure comprising a venting ring 2, a gasket in the form of a standard wad 4, a rubber O-ring 6 and a clamping ring 8. Each component has a central aperture such that the plunger of the trigger sprayer can extend through the same.

The wad includes a venting aperture 10 provided with a covering of polytetrafluoroethylene (PTFE) material 12 which allows therethrough gaseous water but prevents the escape of liquid water droplets.

The venting ring 2 is provided with a plurality of apertures 14 extending through the venting ring to allow gas passing through the material in the wad to escape to the atmosphere, as indicated by arrow 16.

The venting ring 2 is provided with a concentric channel 18 which allows fluid communication between the apertures 14 of the venting ring and the aperture 12 of the wad irrespective of their relative positions.

Figure 6:
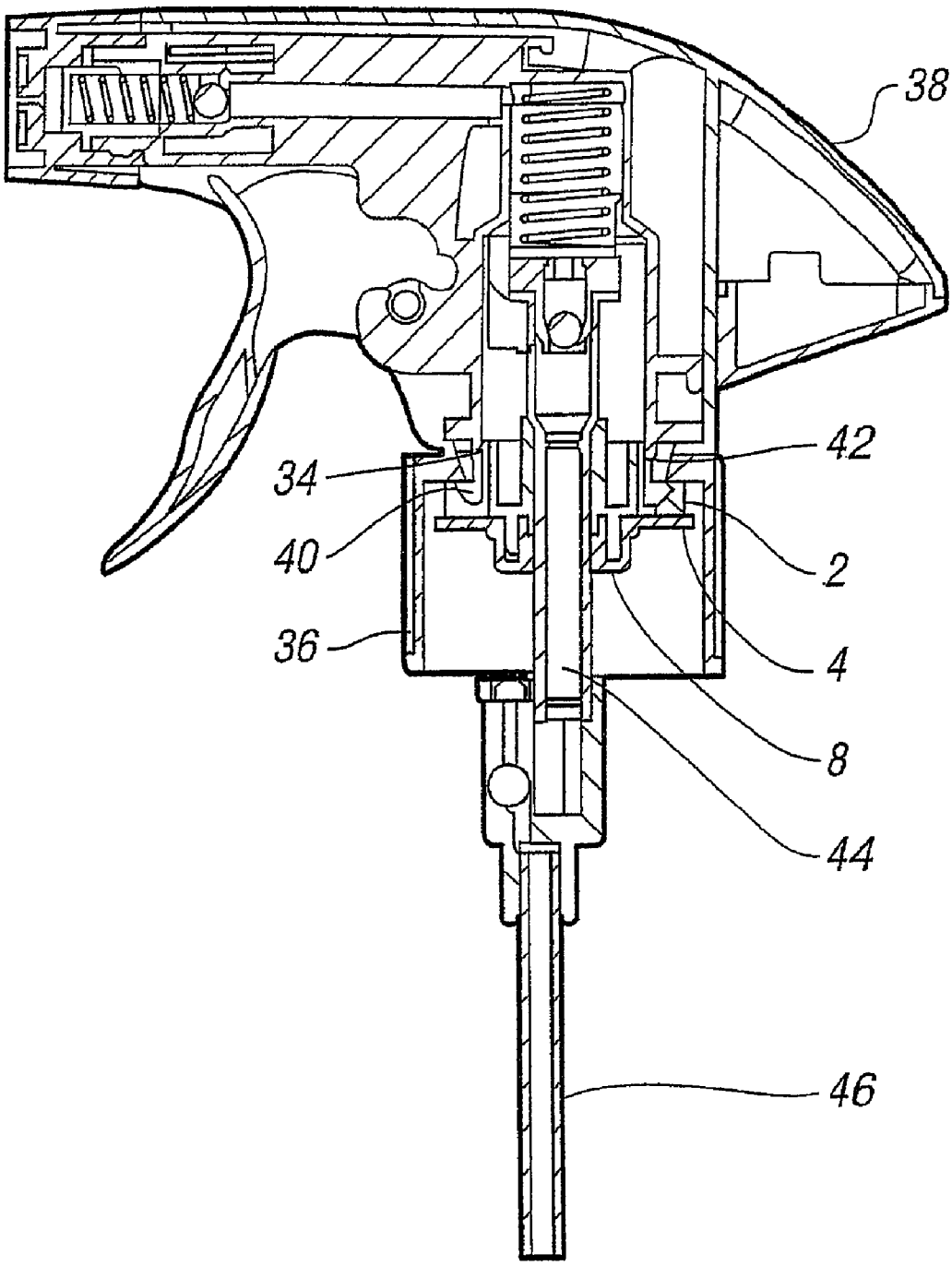
FIG. 6 illustrates a sectional view of a trigger sprayer sprayhead including the venting device of FIG. 1.

With reference to FIG. 6, the venting device fits inside a closure 36 to which a sprayhead 38 is fitted, and the closure is then screwed to the top of a container (not shown) to form a trigger sprayer. The sprayhead is provided with a plunger 44, and a dip tube 46 is fitted to the plunger such that it extends into the liquid of a container fitted thereto to enable pumping of the liquid through the sprayhead.

Thus when the trigger sprayer is transported, if the sprayhead becomes dislodged from the position in which the apertures of the venting ring and wad are aligned, there is no risk of the containers exploding if exposed to heat as the container can continue to vent due to the channel allowing gas to escape from the container irrespective of the sprayhead position.

In addition, this provides a tolerance for manufacturing the trigger sprayer, in that the apertures of the venting ring and wad do not necessarily need to be aligned.

Figure 2:
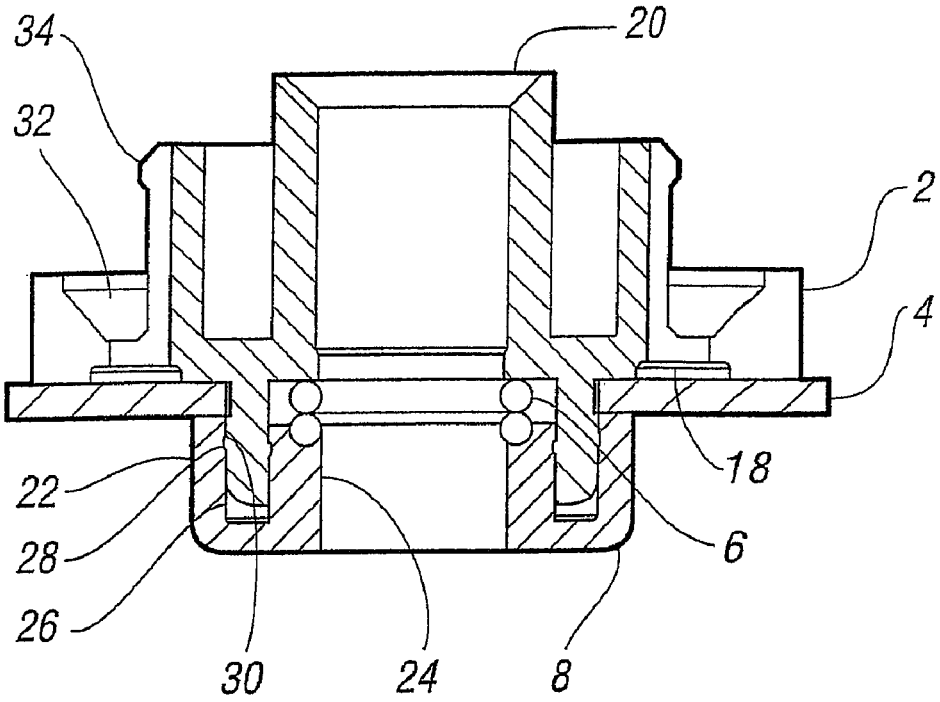
FIG. 2 illustrates a sectional view of the venting device of FIG. 1.
Figure 3:
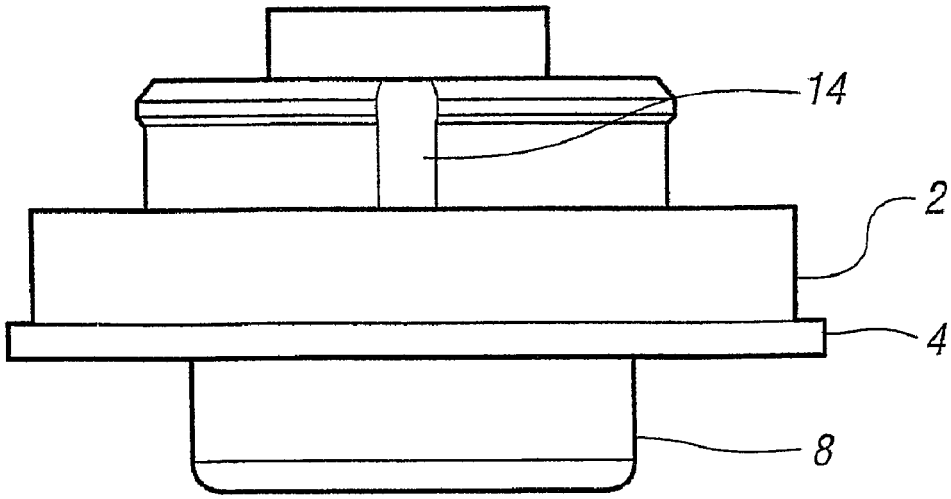
FIG. 3 illustrates a side view of the venting device of FIG. 1.
Figure 4:
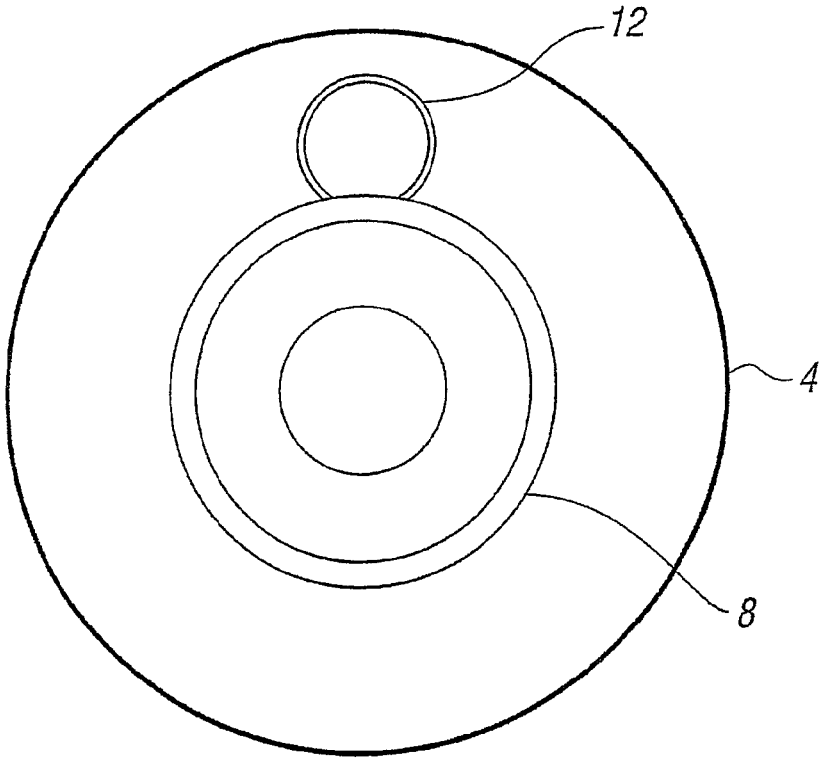
FIG. 4 illustrates a view from below of the venting device of FIG. 1.
Figure 5:
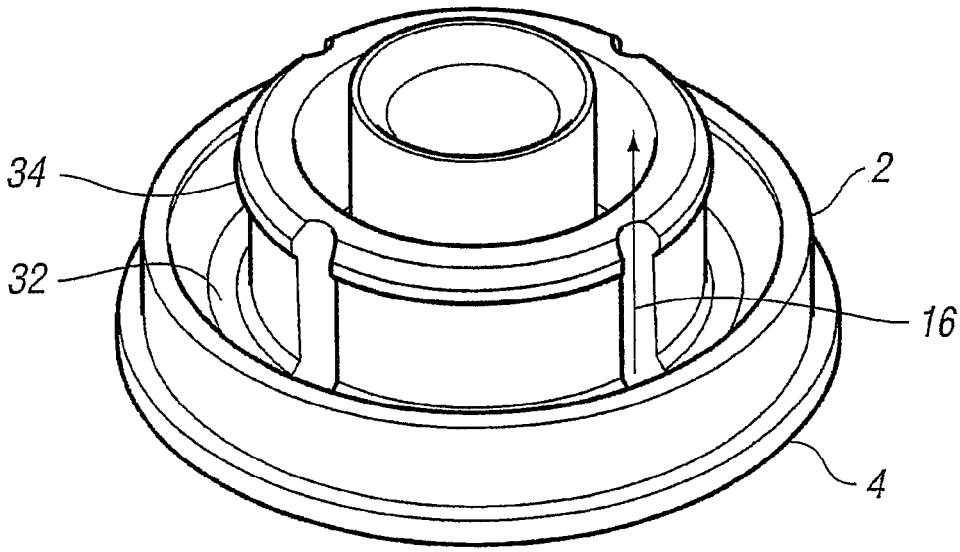
FIG. 5 illustrates an isometric view from above of the venting device of FIG. 1.

With reference to FIG. 2 which shows the assembled venting device, to ensure that liquid from the container does not escape from the central aperture through gaps by the plunger, the O-ring 6 provides a seal against the plunger 20 as it moves up and down through the central aperture of the venting ring 2.

The O-ring 6 and wad 4 are retained in the venting device by the raised inner portion 24 and outer portion 22 respectively of the clamping ring 8. The concentric channel 26 defined between the raised portions is provided with recesses 28 which are engaged by corresponding protrusions 30 on the venting ring 2 to retain the clamping ring 8 to the venting ring 2.

Thus the clamping ring 8 prevents liquid from escaping between the wad and the venting ring, and the O-ring prevents liquid from escaping via gaps adjacent the plunger.

The venting ring is provided with a further channel 32 for receiving the closure-engaging claws 40 of the sprayhead. The edge of the channel is provided with a circumferential ridge 34 which engages a corresponding circumferential groove 42 above the claws 40 on the inside of the sprayhead.

Thus once the claws 40 of the sprayhead have been inserted into the channel 32 of the venting ring 2, the circumferential ridge 34 engages the corresponding groove 42 to retain the sprayhead 38 on the venting ring 2 as shown in FIG. 6. Thus the claws 40 retain the closure to the sprayhead, but as the ridge 34 and groove are circumferential the sprayhead can rotate freely with respect to the closure, the claws moving around the channel 32 unimpeded.

The arrangement of the apertures 14 is different to that of the claws 40 such that at least one aperture is not covered by a claw when the device is assembled with the sprayhead. In addition, the apertures are cut in to the venting ring, such that fluid communication with the channel 18 and the atmosphere is maintained irrespective of the position of the claws.

With reference to FIGS. 3-6 it will be noticed that the diameter of the wad 4 is larger than that of the venting ring 2. This is so that the wad rests on the land of the neck finish of the container such that when the closure is screwed to the container, the wad is sandwiched between the closure and container neck, thereby forming a seal to prevent escape of liquid therebetween.

Thus as the wad is assembled on a component independent of the sprayhead, the venting device provides an anti-back-off feature. As the wad is sealed onto the neck finish of the bottle, if the trigger spray is knocked in transit or during production there is no leakage as the sprayhead turns without unscrewing the closure. The anti-back-off feature is unaffected by the apertures as these are cut into the venting ring.

It will be appreciated by persons skilled in the art that the present invention may also include further additional modifications made to the device which does not affect the overall functioning of the device.

The invention claimed is:

1. A venting device for a trigger sprayer closure, comprising:

a venting ring provided with one or more apertures for allowing the passage of fluid;

a gasket provided with at least one aperture covered by a material for allowing the passage of gas but preventing liquid from passing therethrough;

characterised in that the venting ring is provided with a channel arranged to maintain fluid communication between the one or more apertures of the venting ring and the at least one aperture of the gasket if the relative positions of the respective apertures are changed; and wherein a clamping ring is provided to clamp the gasket to the venting ring, the gasket is provided with a central aperture through which a plunger may extend, and the diameter of said central aperture is smaller than the diameter of the clamping ring, sealing means are provided, being held between the clamping ring and the venting ring, to provide a liquid seal between the venting ring and a plunger when the plunger is extended through the central aperture.

2. A venting device according to claim 1 wherein the device is associable with a closure such that when said closure engages a container, the perimeter of the gasket is sandwiched between the closure and the container.

3. A venting device according to claim 1 wherein the venting ring is provided with a further channel for receiving closure-engaging means of a sprayhead.

* * * * *